United States Patent [19]

Paula

[11] Patent Number: 5,024,344

[45] Date of Patent: Jun. 18, 1991

[54] REUSABLE, FLEXIBLE BAG WITH FOLDABLE SUPPORT STRUCTURE

[76] Inventor: Kyle S. Paula, 140 S. Canon Dr., Beverly Hills, Calif. 90212

[21] Appl. No.: 622,846

[22] Filed: Dec. 6, 1990

[51] Int. Cl.[5] ..... B65D 33/06

[52] U.S. Cl. ..... 220/9.3; 383/12; 383/66; 383/119

[58] Field of Search ..... 220/9.2, 9.3; 383/12, 383/18, 66, 2, 119, 121.1; 190/903

[56] References Cited

U.S. PATENT DOCUMENTS

| | | | |
|---|---|---|---|
| 644,038 | 8/1900 | Whalley | 383/12 |
| 1,633,991 | 6/1927 | Lifton | 383/121.1 |
| 2,014,904 | 9/1935 | Martin | 220/9.3 |
| 2,349,025 | 9/1944 | Wick | 383/6 |
| 2,558,995 | 7/1951 | Tullis | 383/12 |
| 2,650,016 | 2/1953 | McMillan | 383/121 |
| 2,694,812 | 11/1954 | Neuburger | 383/2 |
| 2,772,713 | 12/1956 | Koret | 383/2 |
| 2,785,724 | 3/1957 | Gold | 220/9.2 |
| 3,156,213 | 11/1964 | Patten | 220/9.2 |
| 3,682,372 | 8/1972 | Rodley | 383/2 |
| 4,811,768 | 3/1989 | Williams | 383/66 |

*Primary Examiner*—Gary E. Elkins

[57] ABSTRACT

A reusable bag incorporating a foldable support structure, used for containment of item(s) for carrying by a person, comprising a bag made of a flexible, durable material removably attached to a pair of essentially U-shape, semi-rigid support members, that extend under opposite ends of the bag and up opposite sides at an angle which causes them to intersect just above the mouth of the bag where they are swingably attached to a rigid handle which straddles the mouth of the bag. Attached to the inside of the bag is a rigid bottom panel which lies horizontal on the bottom of the bag when in use and drops to a vertical position when the bag is inverted for folding. Two closure straps with snaps, located on one end near the top edge of the bag whose corresponding snap components are located on the opposite end, are used to maintain the bag in a folded condition. By virtue of this configuration, this bag is free-standing and stable whether empty or full, and may be folded flat when not in use.

16 Claims, 5 Drawing Sheets

REUSABLE, FLEXIBLE BAG WITH FOLDABLE SUPPORT STRUCTURE

BACKGROUND

1. Field of Invention

This invention relates to flexible bags, specifically to reusable bags which are used primarily as, but not limited to, grocery shopping bags.

2. Description of Prior Art

Grocery stores and supermarkets commonly supply consumers with bags to carry their purchases from the store to their vehicle or to their home.

Traditionally, these bags have been made of paper and, more recently, plastic bags have become common. With the environment a matter of great concern, many stores have offered for sale a reusable, canvas type tote bag that consumers will bring to the store each time they shop.

Although this reusable bag does address the environmental problem, each of the above mentioned bags suffer from a number of disadvantages:

(a) The paper bags in present use don't offer any type of handle, making them difficult to carry.

(b) The paper bags and plastic bags in present use have negative effects on the environment: discarded usually after a single use, these disposable bags are wasting trees and adding to already overflowing landfills.

(c) The canvas type tote bags in present use are not freestanding, making them more difficult to fill than a bag that is free-standing. Plastic bags are only free-standing with the assistance of a separate piece of equipment.

(d) These paper, plastic and canvas bags in present use are very unstable when they are filled and being transported in a vehicle. They tend to topple over at stops, starts and turns.

(e) Grocery bags in present use don't offer rigid support at the bag bottom. Thus, when a heavy item is put in, the bag tends to sag, thereby causing the other items in the bag to fall in and possibly become damaged.

Objects and Advantages:

Accordingly, several objects and advantages of my invention are:

(a) To provide a bag to be used primarily as, but not limited to, a grocery shopping bag that is comfortable and easy to carry.

(b) To provide a bag that is reusable, durable and can be used for many years, thus reducing the need for disposable bags that are harmful to the environment.

(c) To provide a bag that is free-standing for easy filling and removal of items.

(d) To provide a bag that is very stable when filled and being transported in a vehicle.

(e) To provide a bag that supports the items inside and distributes the weight over the entire bottom thus eliminating sagging, unstable loads and reducing the possibility of damaged items.

Further objects and advantages are to provide a bag which is completely washable, which can be folded flat when not in use, and which can be disassembled and parts replaced if necessary.

DRAWING FIGURES

| | |
|---|---|
| 10 bag body | 12 support sleeves |
| 14 support members | 16 securing flaps |
| 18 bottom panel strap | 20 through-slot |
| 22 bottom panel | 24 handle |
| 26 closure straps | 28 snaps |
| 30 zipper | |

DESCRIPTION

Figure 1:
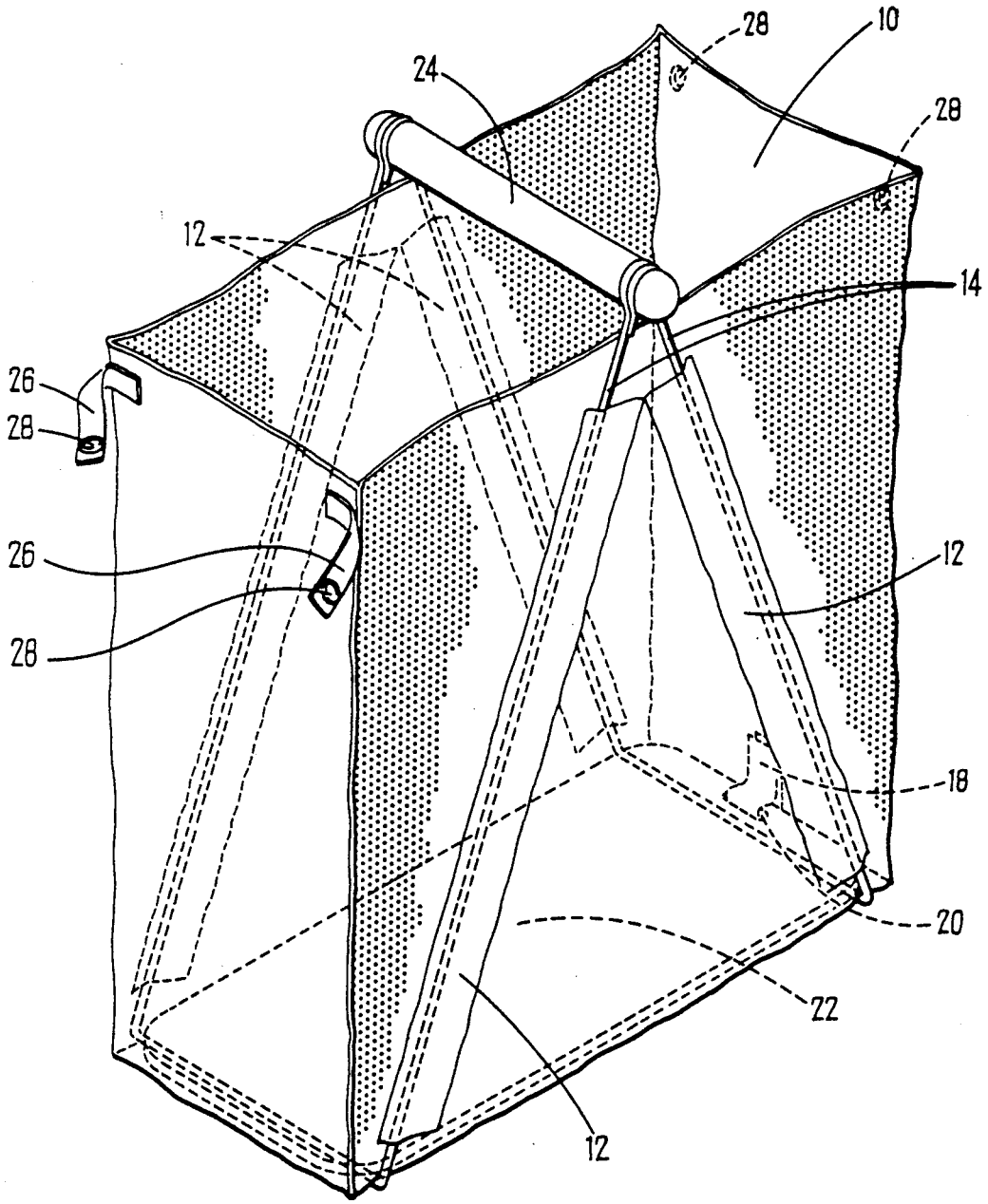
FIG. 1 shows bag in open position from above.
Figure 2:
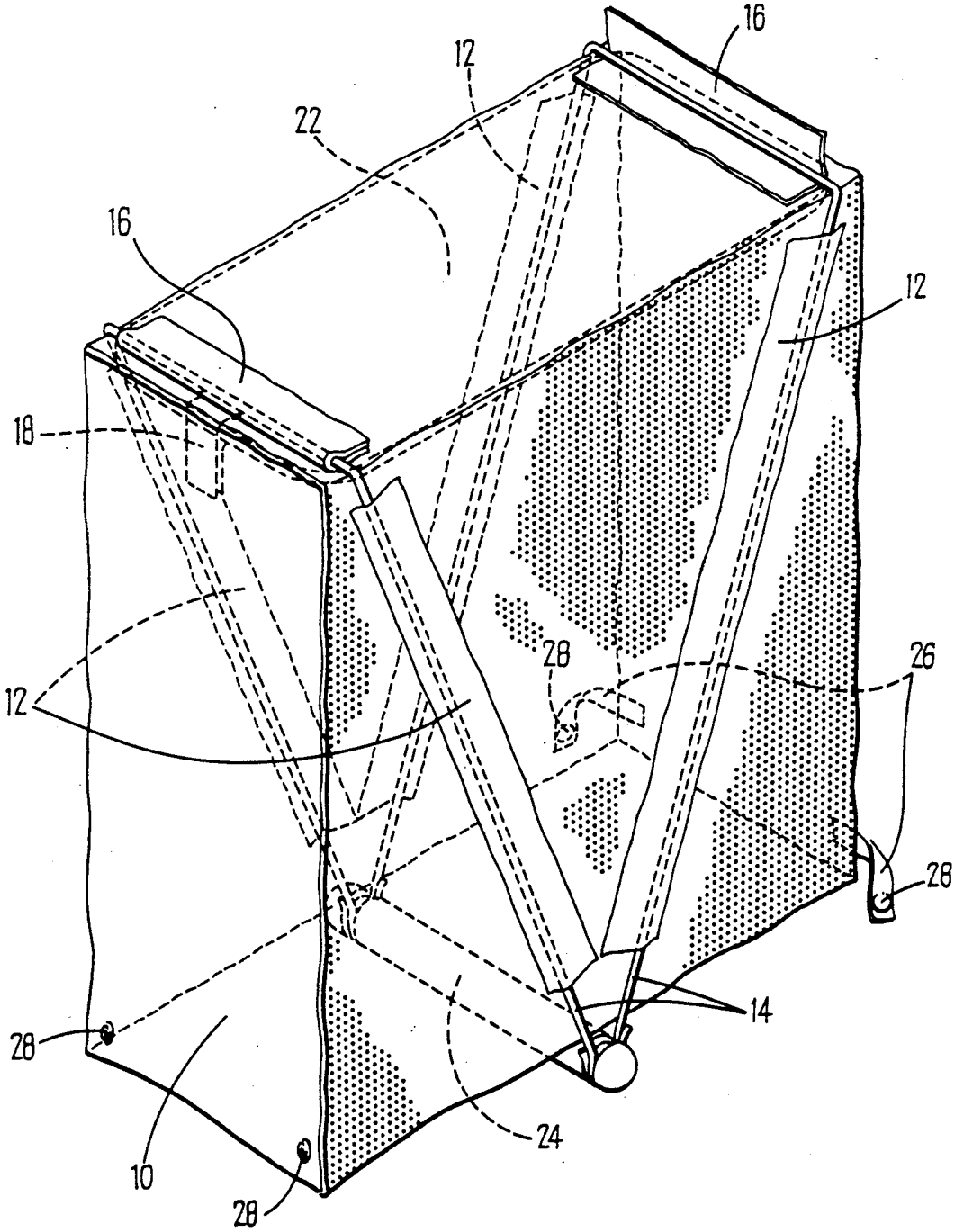
FIG. 2 shows bag inverted in open position, with one of the securing flaps 16, disengaged.
Figure 3:
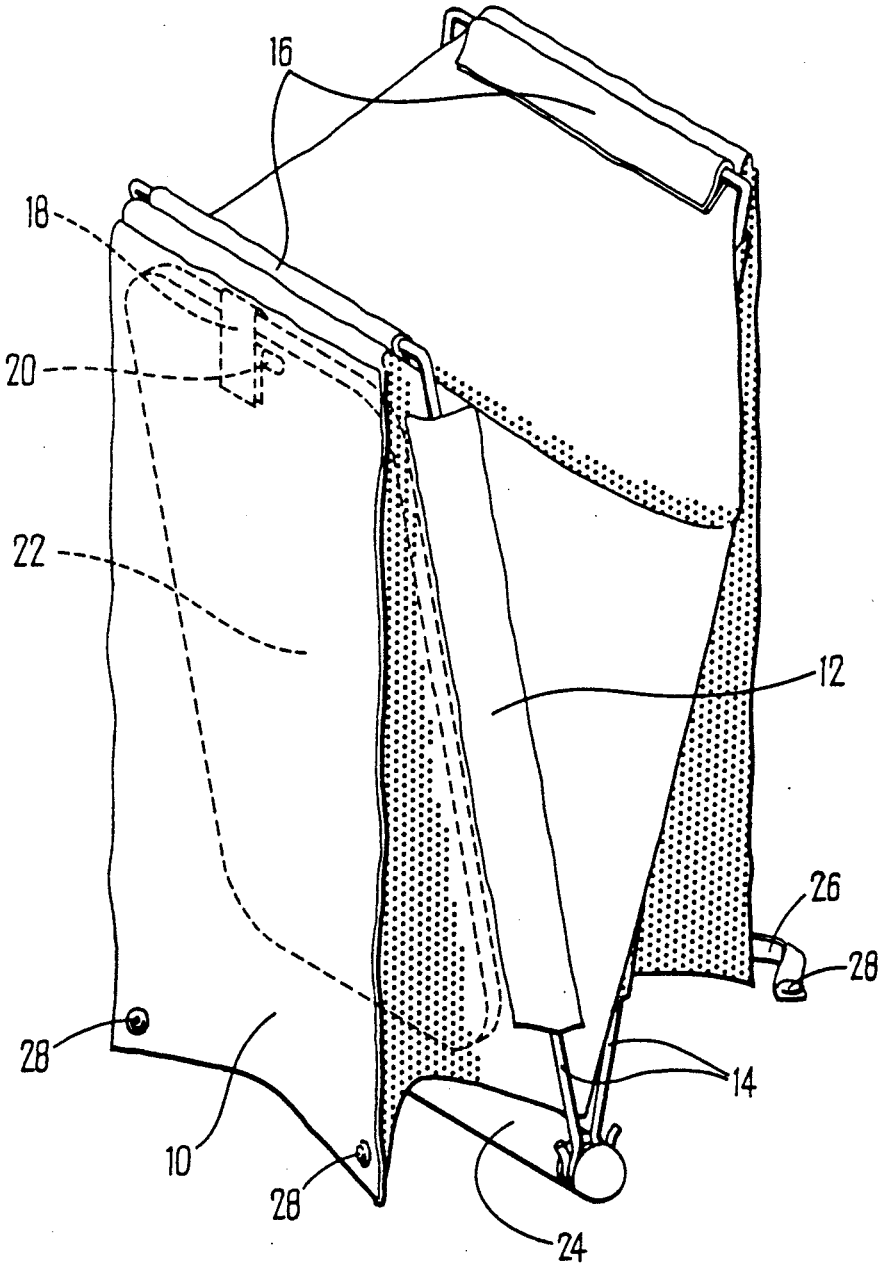
FIG. 3 shows bag inverted in partially folded position.
Figure 4:
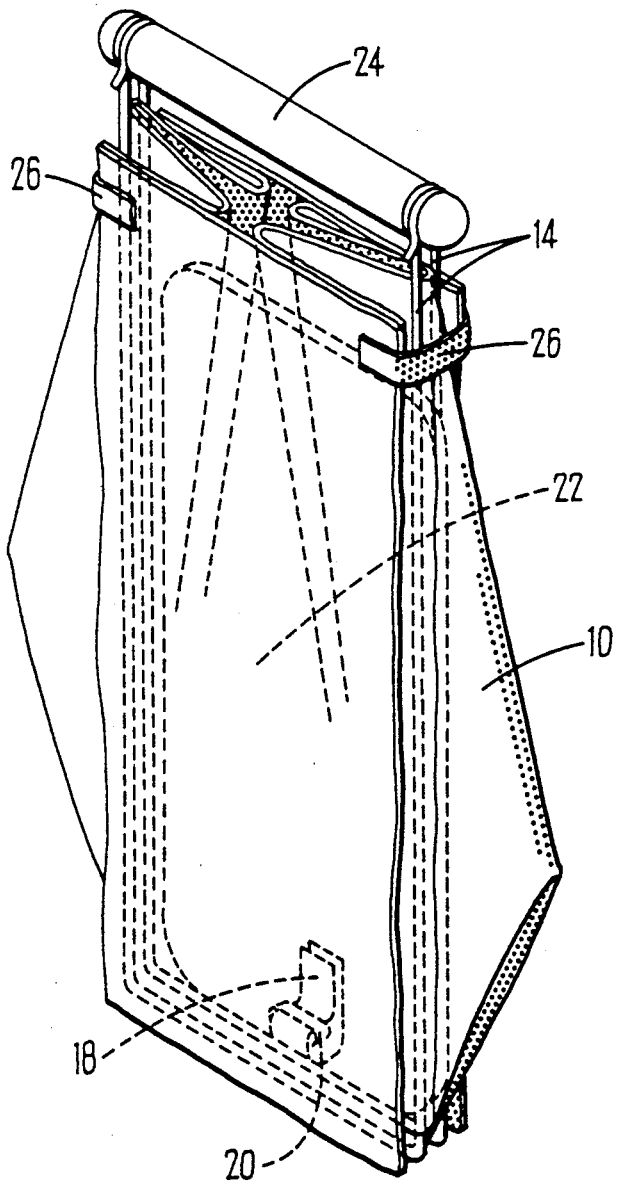
FIG. 4 shows bag in folded position with closure straps 26 engaged.
Figure 5:
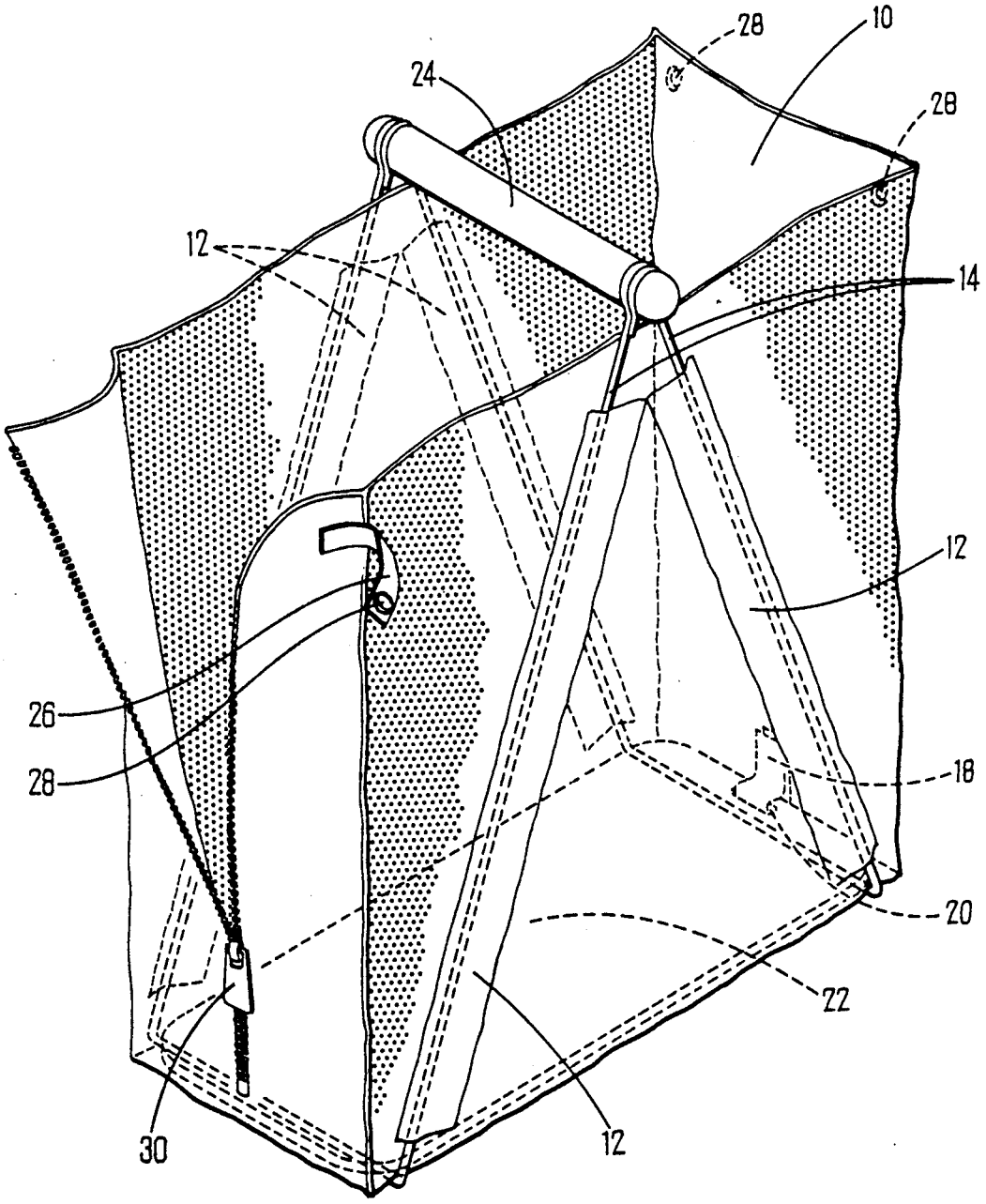
FIG. 5 shows bag in upright position including optional zippered end panel.

FIGS. 1,2,3,4 show a basic version of the invention. FIG. 5 shows bag with optional zippered end wall. All Figs. show a bag body 10, typically made of a flexible fabric-like material sewn or otherwise assembled to form a bag comprising two side walls of equal size, two end walls of equal size, and a bottom wall of a size to form a flat bottom.

Attached to the outside of each side wall are two support sleeves 12. These sleeves are typically made of the same material as the bag body. They are strips that are attached at their side edges only, leaving their top and bottom edges unattached, thereby forming a sleeve through which an upwardly extending portion of a support member 14 may be passed. These sleeves are attached to the bag body 10 at an angle, whereby, when a pair of support members 14 are passed through their respective support sleeves 12, the two upwardly extending portions of one support member intersect the corresponding two upwardly extending portions of the other support member at a point just above the top edge of the bag body 10 midway between the end walls, while positioning the horizontal sections of each support member under the bag body 10, at opposite ends, extending across the width.

Attached to the outside of the bottom wall, one at each end, are two securing flaps 16, typically made of the same material as the bag body 10, which fold over the horizontal portions of the support members 14 and are held in a folded position by hook and loop fastening material, thereby removably attaching the support members 14 to the bag body 10.

Attached to the inside of an end wall, just above where it joins the bottom wall, midway between the side walls is a bottom panel strap 18, made of a flexible material, which runs from its point of attachment through a through-slot 20 in a bottom panel 22, and back to its point of origin where it is removably attached by hook and loop fastening material.

The bottom panel 22, typically made of wood finished with a water repellent sealant, has a length and width equal to the bottom wall, with rounded corners, and a through-slot 20 located near the edge at one end. This through-slot is in a position and is of a size which allows the bottom panel strap 18 to pass through. This configuration allows the bottom panel 22 to lie horizontal on the bottom wall and fully extend the bag body when in the open position. This configuration also allows the bottom panel 22 to fall to a position parallel with the end walls when the bag is inverted to be folded. As seen best in FIG. 3.

The support members 14, are typically two pieces of metal wire, each of which is bent to form, essentially, a U-shape. The upwardly extending sections are equal in length and are perpendicular to the horizontal sections. The dimensions are such that the horizontal sections extend under the bag across the width and the upwardly extending sections extend through the support sleeves 12 and out above the top of the bag body 10. At the ends of each of the four extending sections are parallel hook-like bends which allow a rigid handle 24 to be removably attached.

The handle 24, typically made of wood finished with a water repellent sealant, is of prolate shape and of a length that extends across the width of the bag mouth. A circular groove is located near each end of the handle and is of a size that allows one hook-like bend of each support member 14 to hook around it. The inside dimension of the hook-like bends and the outside diameter of the grooved sections of the handle 24 are such that when the handle is clipped in, it is held in place yet allows for handle rotation. This configuration positions the handle 24 just above the top edge of the bag body 10 midway between the end walls and straddling the bag mouth.

Two closure straps 26, made of a flexible material, are attached on the outside of one of the end walls near the top edge of the bag whereby one end of each strap extends horizontally off opposite edges of the bag. At the end of each of these extending portions are snaps 28 whose corresponding components are attached to the opposite end wall at the same relative position as the closure straps 26.

OPERATION

This bag is designed to be carried at a person's side with the arm extended down and gripped by one hand on the handle 24.

The operation of folding the bag is as follows: Invert the bag, holding it with a hand at each securing flap 16. At this point the bottom panel 22 will fall from its horizontal, in use, position to a vertical position allowing you to bring the securing flaps together collapsing the structure. With the bag in this folded condition the two closure straps 26 can be engaged thereby maintaining folded condition.

The operation of unfolding or opening the bag is as follows: Holding the bag in an upright position, disengage the two closure straps 26. At this point the bottom panel 22 will want to fall into its horizontal, in use, position. Simply reach into the bag and push it down to its horizontal position. This action fully extends the bag body 10 and the support members 14 to their in use position.

The operation of disassembly is as follows: With the hag in open position, reach into the bag and disengage the bottom panel strap 18. The bottom panel 22 may then be removed. Disengage the handle 24 from the support members 14 by pushing the handle out of the hook like bends one at a time. Disengage the securing flaps 16 and remove the support members 14 by pulling them out of the support sleeves 12.

The operation of assembly is as follows: First, slide the two support members 14 up through the support sleeves 12, making sure the openings of the hook like bends of each support member are aligned. Next, fold the securing flaps 16 over the horizontal sections of the support members 14 and secure. Attach the handle 24 by clipping the hook like bends of the support members onto the handle at the grooved sections. Then place the bottom panel 22 in the bag and feed the bottom panel strap 18 up through the through-slot 20 in the bottom panel and secure.

SUMMARY, RAMIFICATIONS, AND SCOPE

Thus the reader will see that the bag of this invention is a reusable, durable easy to use device that can be used primarily as, but not limited to, a grocery shopping bag, thereby reducing the use of disposable paper or plastic bags which are harmful to the environment. Furthermore, this bag offers several other advantages in that

- it is free standing for easy filling and removal of items;
- it is very stable when filled and being transported in a vehicle;
- its rigid bottom distributes the weight of the items over the entire bottom thus eliminating sagging, unstable loads and reducing the possibility of damaged items;
- it is completely washable;
- it can be folded flat for storage;
- it can be easily disassembled and parts can be replaced if necessary;

While one embodiment of the invention is described and illustrated, it is to be understood that they are merely for the purpose of illustration and that other variations are possible. For example, instead of support sleeves to hold the bag body to the support members, the bag body could incorporate a series of "buttonhole" type slits through which the upper extending portions of the support members would be passed in an "over and under" manner. The bag body could also be held to the support members by a series of loops or rings attached to the bag body through which the support members would be passed. Additionally, a zipper may be incorporated in an end wall to enable that end wall to open and close (as shown in FIG. 5,) thereby allowing items that are larger than the mouth of the bag to be inserted, carried and removed easily. This would also provide for easy removal of items regardless of size. Thus it is to be understood that various changes in construction may be resorted to in the course of manufacture in order that the invention may be utilized to the best advantage according to circumstances which may arise, without in any way departing from the spirit and intention of the invention, which is to be limited only in accordance with the appended claims. While there is stated the primary use of the invention, it remains obvious that it may be employed in any other capacity wherein it may be found applicable.

I claim:

1. A reusable, flexible bag, incorporating a foldable support structure, to be used for containment of an item or items comprising:

a) a bag body made of a sheet of flexible material having essentially vertical walls and an essentially horizontal bottom wall which form a container with an opening at the top;

b) a handle;

c) a pair of support members made of a semi-rigid material having horizontal portions which extend under said bottom wall and having upwardly extending portions with ends, said upwardly extending portions extending up along said vertical walls with said ends located above said opening of said bag body, said ends swingably attached to said handle;

d) a bottom panel made of a rigid material formed to lie inside said bag body coextensive with said bottom wall freely attached to said bag body.

2. The flexible bag of claim 1 wherein said bag body has two essentially vertical side walls, two essentially vertical end walls and an essentially horizontal bottom wall, each said side wall having two support sleeves through which said upwardly extending portions of said support members extend and by which said bag body is attached to said support members.

3. The flexible bag of claim 2 wherein said handle is made of a rigid material, prolate shaped with two circular grooves, one said groove located near each end of said handle, said handle straddling said opening of said bag body.

4. The flexible bag of claim 3 wherein said pair of support members are essentially U-shaped and have at each end, hook-like bends which clip onto said grooves in said handle thereby swingably attaching said support members to said handle.

5. The flexible bag of claim 4 further including a through-slot in said bottom panel and further including a bottom panel strap which extends through said through-slot, said bottom panel strap having two ends, one of said ends permanently attached to said bag body and the other of said ends removably attached to said bag body, thereby freely attaching said bottom panel to said bag body, whereby said bottom panel can move between a position coextensive with said bottom wall and a position parallel with said end walls.

6. The flexible bag of claim 5 wherein one of said end walls further includes a closable opening thereby allowing the insertion and removal of items larger than said opening at the top of said bag body.

7. A reusable, flexible bag, incorporating a foldable support structure, to be used for containment of an item or items comprising:

a) a bag body made of a sheet of flexible material having essentially vertical walls and an essentially horizontal bottom wall which form a container with an opening at the top;

b) a handle made of a rigid material which straddles said opening of said bag body;

c) a pair of support members made of a semi-rigid material attached to said bag body, each said support member having a horizontal portion which extends under said bottom wall and each having two upwardly extending portions which extend up along said side walls terminating above said opening of said bag body swingably attached to said handle;

d) a bottom panel made of a sheet of rigid material of a size which allows it to lie inside said bag body coextensive with said bottom wall, freely attached at one end to the inside of said bag body.

8. The flexible bag of claim 7 wherein said bag body has two essentially vertical side walls, two essentially vertical end walls and an essentially horizontal bottom wall, each said side wall having two support sleeves through which said upwardly extending portions of said support members extend and by which said bag body is attached to said support members.

9. The flexible bag of claim 8 wherein said handle is prolate shaped with two circular grooves, one of said grooves located near each end of said handle.

10. The flexible bag of claim 9 wherein said pair of support members are essentially U-shaped, and wherein said upwardly extending portions having hook-like bends which clip onto said grooves in said handle thereby swingably and detachably attaching said support members to said handle.

11. The flexible bag of claim 10 further including a through-slot near an end of said bottom panel and further including a bottom panel strap which runs through said through-slot, said bottom panel strap having two ends, one of said ends being attached to said bag body and the other of said ends removably attached to said bag body thereby freely attaching said bottom panel to said bag body in a manner which allows said bottom panel to move between a position coextensive with said bottom wall and a position parallel with said essentially vertical end walls.

12. The flexible bag of claim 11 further including a closable opening in one of said end walls, whereby items larger than said opening of said bag body may be inserted and removed.

13. A reusable, flexible bag, incorporating a foldable support structure, to be used for containment of an item or items comprising:

a) a bag body made of a fabric-like flexible material having two essentially vertical side walls, two essentially vertical end walls and an essentially horizontal bottom wall which form a container with an opening at the top;

b) a handle which straddles said opening of said bag body made of a rigid material, prolate shaped with two circular grooves, one of said grooves located near each end of said handle;

c) a pair of essentially U-shaped support members made of a semi-rigid material attached to said bag body, each said support member having a horizontal portion which extends under said bottom wall and each having two upwardly extending portions which extend from said horizontal portions up along said vertical side walls terminating above said opening of said bag body, with hook-like bends which clip onto said grooves in said handle, thereby swingably and removably attaching said support members to said handle;

d) a bottom panel made of a sheet of rigid material of a size that approximates the length and width of said bottom wall, freely attached at one end to the inside of said bag body, whereby said bottom panel can move between a position coextensive with said bottom wall and a position parallel with a vertical end wall.

14. The flexible bag of claim 13 wherein each said side wall has two support sleeves, through which said upwardly extending portions of said support members extend and by which said bag body is attached to said support members.

15. The flexible bag of claim 14 further including a through-slot located near one end in said bottom panel and further including a bottom panel strap which runs through said through-slot, said bottom panel strap having two ends, one of said ends being permanently attached to the inside of said bag body and the other of said ends removably attached to said bag body, thereby freely attaching said bottom panel to said bag body.

16. The flexible bag of claim 15 wherein one of said end walls further includes a zipper or other means for opening and closing said end wall, thereby allowing for the insertion and removal of items larger than said opening at the top of said bag body.

* * * * *